US006727510B2

(12) United States Patent
Matsunaga et al.

(10) Patent No.: US 6,727,510 B2
(45) Date of Patent: Apr. 27, 2004

(54) TRANSPORTATION VESSEL FOR RADIOACTIVE SUBSTANCE AND METHOD OF LOADING CLOSED VESSEL

(75) Inventors: Kenichi Matsunaga, Kobe (JP); Genji Abe, Kobe (JP); Koichi Ue, Kobe (JP); Koji Enami, Takasago (JP); Seiichi Wakayama, Takasago (JP); Etsuryo Kita, Kobe (JP); Shizuo Inoue, Kobe (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/178,719

(22) Filed: Jun. 25, 2002

(65) Prior Publication Data

US 2003/0004390 A1 Jan. 2, 2003

(30) Foreign Application Priority Data

Jun. 29, 2001 (JP) ..... 2001-200175

(51) Int. Cl.[7] ..... G21F 5/00

(52) U.S. Cl. ..... 250/496.1; 250/506.1; 250/507.1; 376/272; 137/347; 137/585; 105/358; 105/360

(58) Field of Search ..... 250/496.1, 506.1, 250/507.1; 376/272; 137/347, 585; 105/358, 360

(56) References Cited

U.S. PATENT DOCUMENTS 5,061,858 A * 10/1991 Mallory ..... 250/507.1
5,251,658 A * 10/1993 Zink ..... 137/347
5,894,134 A * 4/1999 Kissinger ..... 250/506.1

* cited by examiner

*Primary Examiner*—John R. Lee
*Assistant Examiner*—Zia R. Hashmi
(74) *Attorney, Agent, or Firm*—Oblon, Spivak, McClelland, Maier & Neustadt, P.C.

(57) ABSTRACT

A canister containing spent fuel assemblies is contained in a body of a transportation cask. A top opening of a vessel body of the canister is closed by a lid welded to the vessel body. A ring-shaped elastic tube is provided between the inner surface of the upper end portion of the body and the outer surface of the upper end portion of the vessel body. The tube seals the gap between these surfaces to prevent a fluid from getting into the gap between the surfaces through the top opening of the body. An inspection space for the insertion of a tester for detecting the welding state of the lid is defined between the inner surface of the upper end portion of the body and the outer surface of the upper end portion of the vessel body.

11 Claims, 4 Drawing Sheets

TRANSPORTATION VESSEL FOR RADIOACTIVE SUBSTANCE AND METHOD OF LOADING CLOSED VESSEL

CROSS-REFERENCE TO RELATED APPLICATIONS

This application is based upon and claims the benefit of priority from the prior Japanese Patent Application No. 2001-200175, filed Jun. 29, 2001, the entire contents of which are incorporated herein by reference.

BACKGROUND OF THE INVENTION

1. Field of the Invention

The present invention relates to a transportation vessel for transporting a closed vessel, or a so-called canister, containing radioactive substance that involves heat release, and a method of loading the closed vessel.

2. Description of the Related Art

Highly radioactive substances represented by spent fuels from nuclear reactors are reprocessed in order to recover plutonium or some other useful substances that can be used again as fuels. The highly radioactive substances are contained before they are reprocessed. In this case, the spent fuels are put into canisters in a nuclear power plant, and the canisters are transported, in transportation vessels or so-called transportation casks, by ship or truck to a containing facility. Since the spent fuels are highly radioactive, the transportation casks containing them are expected to have high sealing and shielding properties.

Usually, the canister comprises a tubular metallic vessel body closed at the bottom and a basket located in the vessel body. A plurality of spent fuel assemblies are sealed in the vessel body in a manner such that they are supported by means of the basket. A top opening of the vessel body is closed by means of a primary lid and a secondary lid that are welded together.

In general, a transportation cask comprises an open-topped cask body formed of a metal such as stainless steel or carbon steel and a neutron shield, which is formed of a high-molecular material or synthetic resin, for example, and covers the outer periphery of the vessel body. A top opening of the cask body is closed by a bolted lid.

In transporting the canister in the transportation cask from a power plant to a desired facility, the spent fuel is contained in the canister and then in the transportation cask by the following processes.

First, in a decontamination pit, the empty vessel body of the canister is put into the transportation cask with its upper end open, and preparations are made for fuel loading. The basket is set in advance in the vessel body. Subsequently, the transportation cask, having the vessel body therein, is transferred to a cask loading pit filled with cooling water, and is immersed in the cooling water. Thereupon, the canister and the cask are filled with the cooling water.

In the cask loading pit, the spent fuel assemblies, having so far been contained in a spent fuel pit, are pulled out one after another by means of a pit crane and loaded in succession into the basket in the vessel body. After a given number of spent fuel assemblies are loaded into the vessel body, the shielding plate is fitted into the top opening of the vessel body.

Subsequently, the transportation cask is pulled up from the cask loading pit and transferred to the decontamination pit by means of an overhead traveling crane. In the decontamination pit, a suitable quantity of cooling water is discharged from the vessel body so that the surface of the cooling water in the cask is situated slightly above the spent fuel assemblies, and water in the gap between the canister and the transportation cask is removed.

After the primary lid is welded to the vessel body of the canister to close its opening, in this state, complete dehydration, vacuum drying, inert gas replacement, sealing operation, welding portion inspection, and air leakage inspection are carried out. Further, the secondary lid is welded, and inert gas replacement in the space between the primary and secondary lids, sealing operation, welding portion inspection, and air leakage inspection are carried out. Thus, seal-welding operation for the lids of the canister is finished, whereupon the canister is completed contained the spent fuel.

Thereafter, the top opening of the transportation cask is closed by means of a lid, and a pre-transportation check is conducted, whereupon pre-shipment preparations are completed. Then, the transportation cask, thus containing the canister, is transported from a power plant to a containing facility.

In loading the spent fuel assemblies into the canister, in the transportation cask constructed in this manner, the canister surface and the inner surface of the transportation cask are also brought into contact with the cooling water and contaminated with radioactivity. In any stage before the transportation, therefore, the canister must be loaded again into the transportation cask after it is temporarily drawn out of the cask to have its outer surface washed and checked for contamination.

Thus, the operation for loading the canister into the transportation cask is very troublesome. In raising the canister from or loading it into the transportation cask, moreover, there is a possibility that the canister will fall by mistake, resulting in damage to the canister and the transportation cask.

Usually, the primary and secondary lids of the canister are checked for the welding state by an ultrasonic sensor or the like after they are welded. In this case, however, the canister is contained in the transportation cask, and the gap between the outer surface of the canister and the inner surface of the transportation cask is narrow. Accordingly, the welding portion can be inspected only from above the canister, so that it is hard to check up on the welding state accurately.

BRIEF SUMMARY OF THE INVENTION

The present invention has been contrived in consideration of these circumstances, and its object is to provide a transportation vessel, capable of preventing contamination of the outer surface of a canister as a radioactive substance and the canister are loaded and simplifying the loading operation, and a loading method for a closed vessel.

In order to achieve the above object, a transportation vessel according to an aspect of the invention is a vessel for contained and transporting a closed vessel, which comprises a substantially tubular metallic vessel body, having a closed bottom and a top opening and configured to contain radioactive substance, and a lid welded to the vessel body and closing the top opening of the vessel body. The transportation vessel comprises: a body having a top opening and provided inside with a containing portion configured to contain the closed vessel; a lid closing the top opening of the body; and a ring-shaped seal member provided between the outer surface of the closed vessel and the inner surface of the body, near the top opening, and configured to seal the gap between the outer surface of the closed vessel and the inner surface of the body and to prevent a fluid from getting into the gap between the outer and inner surfaces through the top opening.

A method of loading a closed vessel with a radioactive substance into a transportation vessel, according to another aspect of the invention, comprises: locating an empty vessel body with an opened top of the closed vessel in the containing portion of an open-topped body of the transportation vessel; sealing the gap between the outer surface of the vessel body and the inner surface of the body by means of a ring-shaped seal member provided between the outer surface of the vessel body and the inner surface of the body, near the top opening of the body, thereby preventing a fluid from getting into the gap between the vessel body and the inner surface of the body through the top opening; immersing the body containing the vessel body in water in a state such that the gap between the outer surface of the vessel body and the inner surface of the body is sealed by the seal member; loading a radioactive substance into the vessel body in the water; setting a shield member in the top opening of the vessel body in the water after loading the radioactive substance; pulling up the body from the water after setting the shield member and then discharging a given quantity of water from the vessel body and the body; and welding the lid to the inner surface of the vessel body after discharging the water.

According to the transportation vessel constructed in this manner and the loading method, the fluid can be prevented from getting into the gap between the vessel body of the closed vessel and the inner surface of the body through the top opening of the body by sealing the gap between the vessel body and the inner surface of the body by means of the ring-shaped seal member that is provided between the outer surface of the vessel body and the inner surface of the body near the top opening. Thus, in immersing the body, containing the vessel body of the closed vessel, in the water to set the radioactive substance in position, the water can be prevented from flowing into the gap between the vessel body and the inner surface of the body through the top opening of the body. In consequence, the outer surface of the vessel body can be prevented from being contaminated with the water. Accordingly, the closed vessel can be washed without being pulled up from the body of the transportation vessel. Thus, there may be provided a transportation vessel and a closed vessel loading method such that the radioactive substance and the closed vessel can be loaded with ease.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

DETAILED DESCRIPTION OF THE INVENTION

A transportation cask according to an embodiment of the present invention will now be described in detail with reference to the accompanying drawings.

Figure 1:
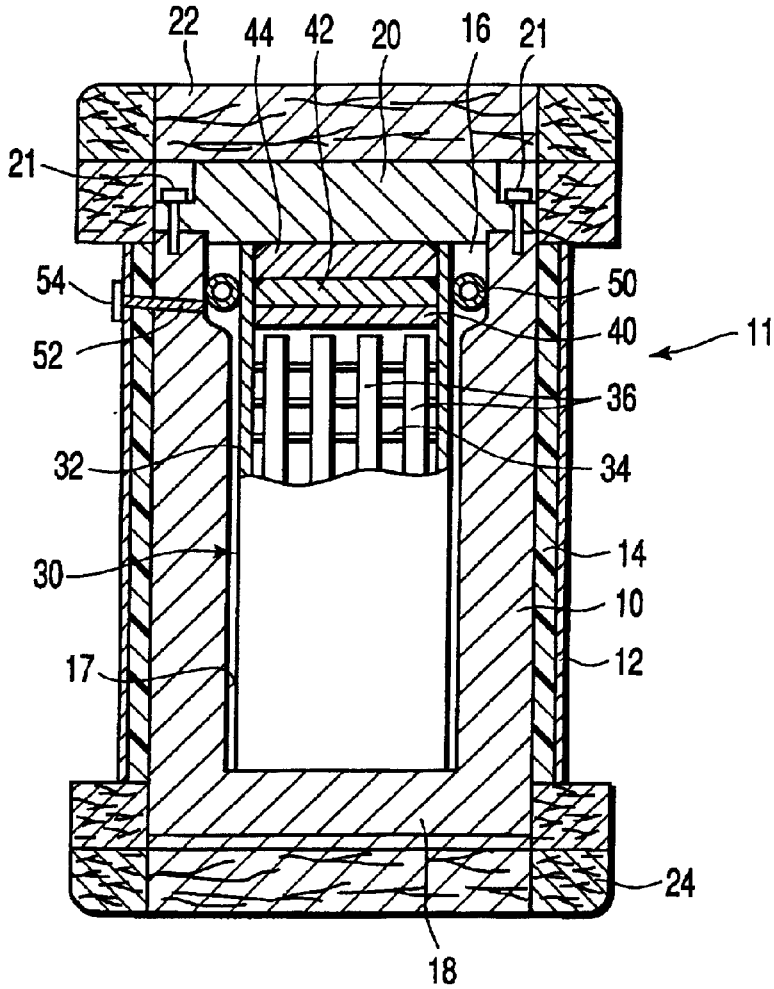
FIG. 1 is a longitudinal sectional view showing a transportation cask according to an embodiment of the invention.

As shown in FIG. 1, a transportation cask 11 according to the present embodiment comprises a substantially cylindrical body 10, formed of stainless steel, carbon steel, or some other metal, an outer tube 12 coaxial with the body 10 and constituting the outer surface of the cask, and a neutron shielding layer 14 of a high-molecular material that contains hydrogen, for example. The neutron shielding layer 14 is provided between the body 10 and the outer tube 12 and serves as a neutron shield. The body 10 has its upper end open and its lower end closed by means of a bottom wall 18 that is welded to it. Thus, a containing portion 17 is formed in the body 10.

Figure 2:
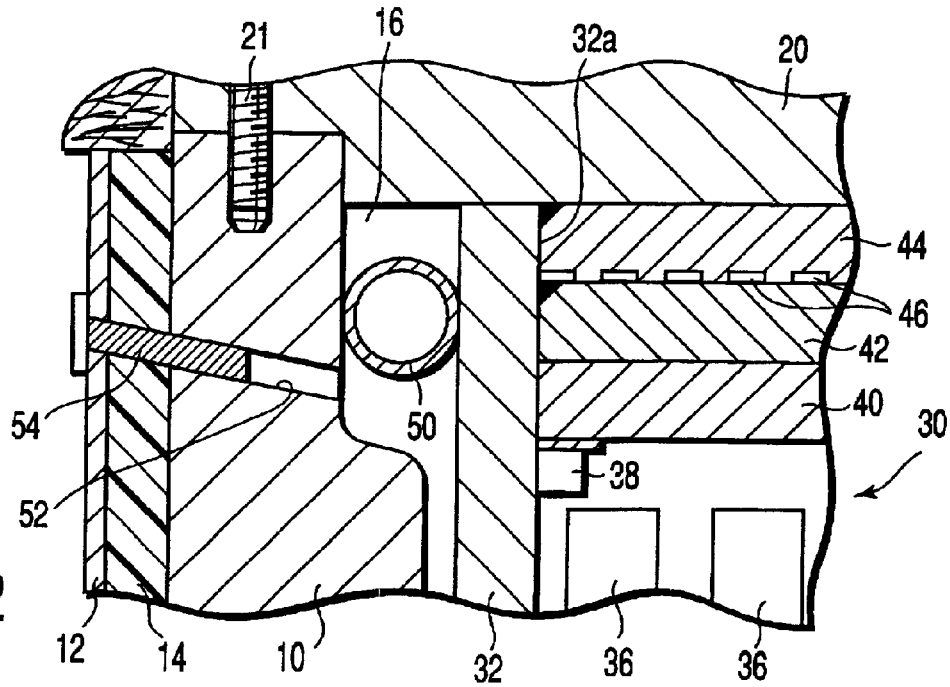
FIG. 2 is an enlarged sectional view showing the upper part of the body of the transportation cask and the upper end portion of a canister contained in the transportation cask.

As shown in FIGS. 1 and 2, a canister 30 for use as a closed vessel is contained in the body 10 or the containing portion 17 of the transportation cask 11. Further, spent fuel assemblies as radioactive substances are contained in the canister 30.

Figure 3:
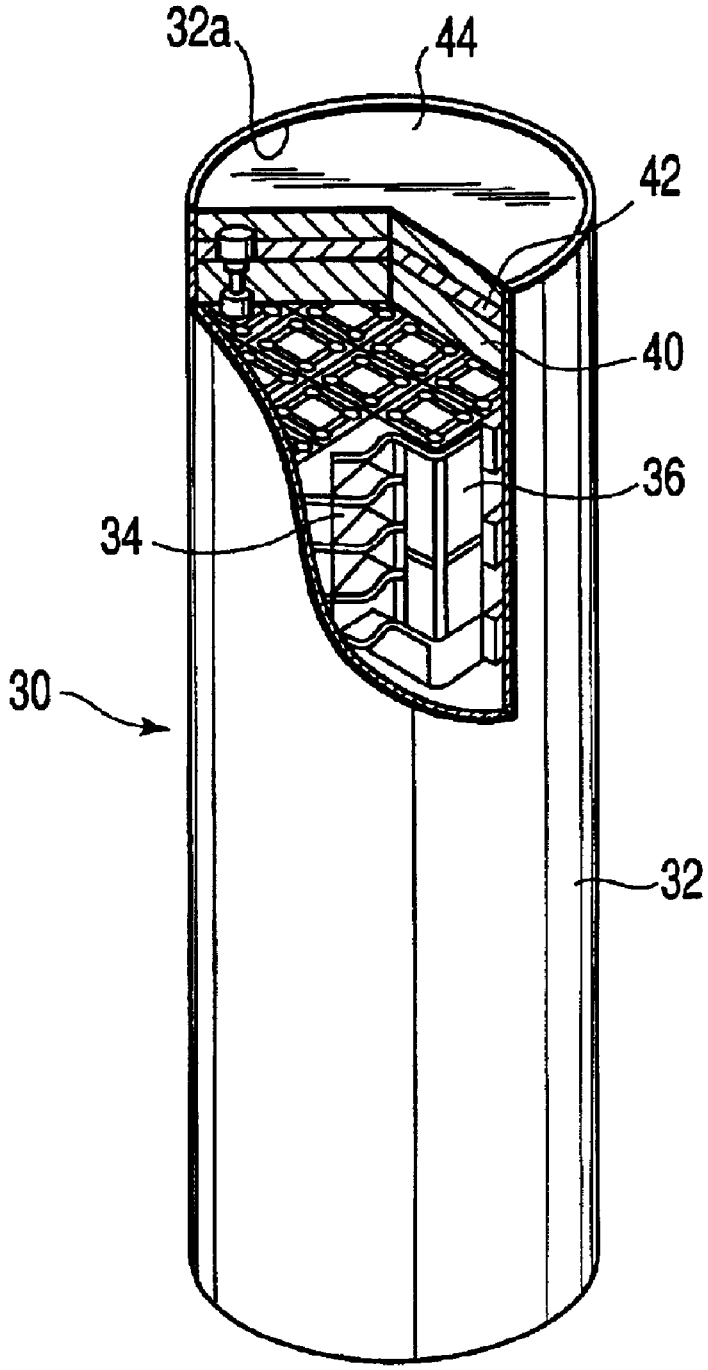
FIG. 3 is a cutaway perspective view of the canister.

More specifically, as shown in FIGS. 1 to 3, the canister 30 comprises a substantially cylindrical vessel body 32 that is closed at the bottom and has a top opening 32*a*. The vessel body 32 is formed of a metal such as stainless steel.

The vessel body 32 has an outside diameter a little smaller than the inside diameter of the body 10 of the transportation cask 11, and can be inserted into the body 10. A plurality of spent fuel assemblies 36 are sealed in the vessel body 32 in a manner such that they are supported by a basket 34. The basket 34 is formed of a composite material that combines boron and aluminum or SUS. The spent fuel assemblies 36 are formed of a spent fuel from a nuclear reactor, for example, and contain a radioactive substance that involves heat release attributable to decay heat and generation of radiation. The canister 30 has a weld-sealed structure to prevent the sealed radioactive substance from leaking out. Further, the vessel body 32 is filled with helium gas under a negative or positive pressure.

A plurality of support blocks 38, e.g., four in number, are fixed on the inner peripheral surface of the upper end portion of the vessel body 32. The support blocks 38 are arranged at equal spaces in the circumferential direction. A disk-shaped shielding plate 40 overlies the support blocks 38 with a ring-shaped support plate between them, thereby closing the top opening of the vessel body 32.

Further, a disc-shaped primary lid 42 is lapped on the shielding plate 40 in the top opening 32*a* of the vessel body 32, thereby closing the top opening of the vessel body. The topside part of the outer peripheral portion of the primary lid 42 is welded to the inner peripheral surface of the vessel body 32, covering the whole circumference.

Furthermore, a disc-shaped secondary lid 44 is lapped on the primary lid 42 in the top opening 32*a* of the vessel body 32. The topside part of the outer peripheral portion of the secondary lid 44 is welded to the inner peripheral surface of the vessel body 32. A plurality of recesses 46 are formed on the inner surface of the secondary lid 44. The whole inner surface of the secondary lid 44 except the recesses 46 is in intimate contact with the upper surface of the primary lid 42.

These recesses 46 define closed spaces that serve as inspection spaces for monitoring between the primary and secondary lids 42 and 44. The closed spaces are kept at a negative or positive pressure inside. Thus, a pressure barrier is defined between the inside and outside of the canister 30, so that the closed state can be monitored and the airtight leakage inspection can be carried out.

As described above, the top opening 32*a* of the vessel body 32 is hermetically closed by means of the shielding plate 40, primary lid 42, and secondary lid 44. The shielding plate 40, primary lid 42, and secondary lid 44 are formed of a metal such as stainless steel.

The canister 30 with the aforementioned construction is contained coaxially in the containing portion 17 of the body 10 of the transportation cask 11 and placed on the bottom wall 18. In this state, a narrow gap is formed between the outer peripheral surface of the canister 30 and the inner surface of the body 10.

As shown in FIGS. 1 and 2, the inside diameter of the body 10 is a little greater than the outside diameter of the canister 30. The upper end portion of the containing portion 17 is formed having an inside diameter greater than that of the remaining portion, so that the containing portion 17 is stepped. Thus, an annular inspection space 16 for the insertion of a tester is formed in the upper end portion of the containing portion 17. The inspection space 16 is situated around the upper end portion of the canister 30, that is, outside the primary and secondary lids 42 and 44.

A ring-shaped elastic tube 50 for use as a seal member is located in the inspection space 16. The elastic tube 50, which is formed of rubber, for example, can be inflated by being externally supplied with compressed air. The tube 50 is fixed to the inner peripheral surface of the body 10, and is liquid-tightly in contact with the inner peripheral surface of the body and the outer peripheral surface of the canister 30 in the inspection space 16. Thus, the elastic tube 50 seals the gap between the inner surface of the body 10 and the outer surface of the canister 30, thereby preventing a fluid from getting into the gap between the body 10 and the canister 30 through the top-opening side of the body.

One or more supply holes 52 are formed penetrating the outer periphery of the upper end portion of the body 10, and open into a space that is sealed by means of the elastic tube 50. In the present embodiment, the supply holes 52 open into the inspection space 16 under the elastic tube 50. The fluid can be supplied from outside the body 10 to the space between the outer surface of the canister 30 and the inner surface of body 10, which is sealed by means of the elastic tube 50. Normally, each supply hole 52 is closed by a plug 54.

As shown in FIGS. 1 and 2, the top opening of the body 10 of the transportation cask 11 is closed by means of a lid 20 that is formed of a metal such as stainless steel or carbon steel. The lid 20 is fastened to the upper end face of the body 10 by bolts 21. The inner surface of the lid 20 is intimately in contact with the outer surface of the secondary lid 44 of the canister 30.

Further, the transportation cask 11 is provided with shock absorbers 22 and 24 that are attached to the upper and lower end portions of the body 10, respectively. The shock absorbers 22 and 24 are substantially disc-shaped members of wood, for example.

The shock absorber 22 is fitted on and screwed to the upper end portion of the body 10 and covers the whole outer surface of the lid 20. On the other hand, the shock absorber 24 is fitted on and screwed to the lower end portion of the body 10 and covers the whole outer surface of the bottom wall 18.

The following is a description of a method for setting the spent fuel assemblies 36 and the canister 30 in the transportation cask 11 constructed in this manner.

Figure 4:
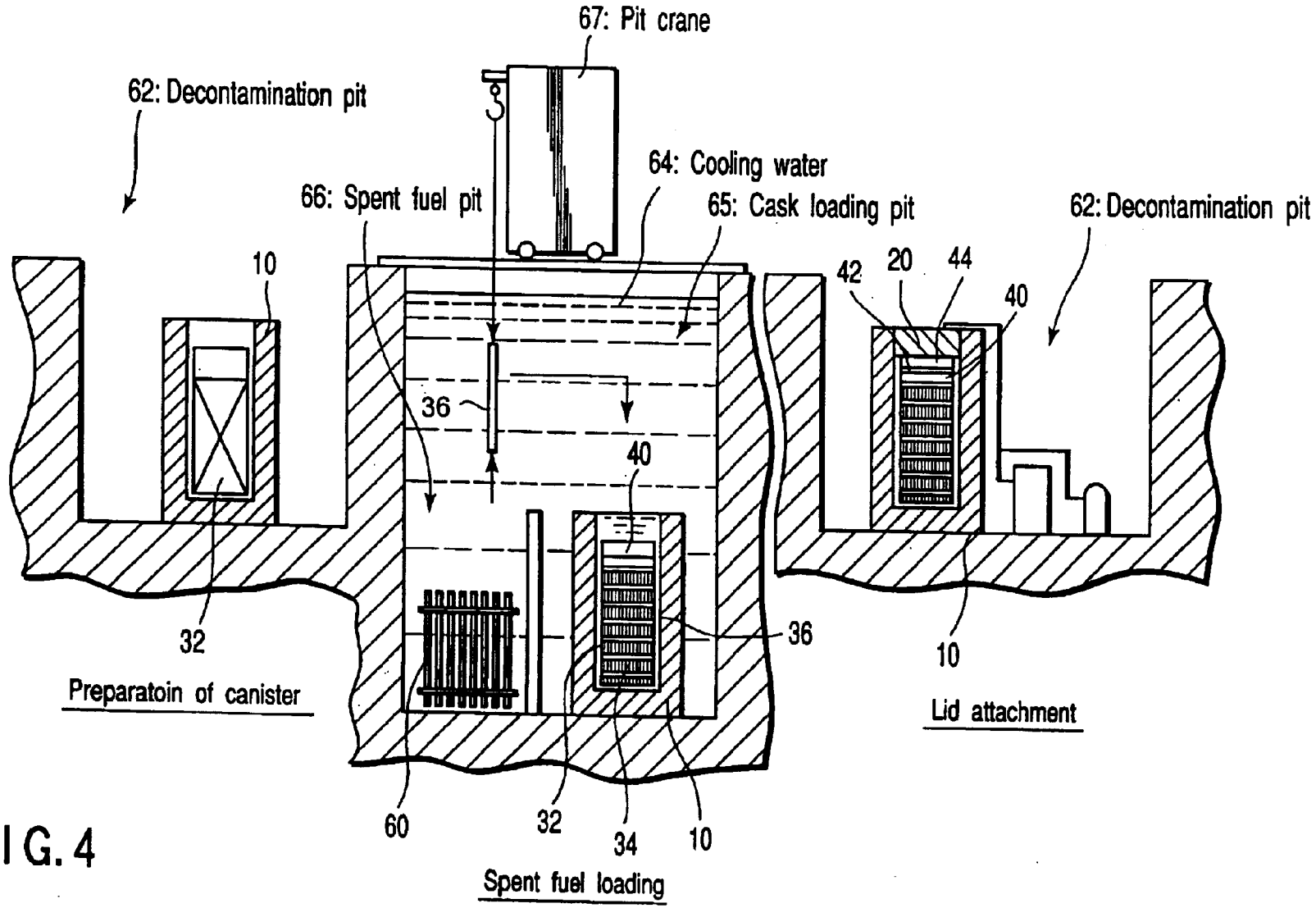
FIG. 4 is a view schematically showing a spent fuel loading process for the canister and a lid welding process.

In a decontamination pit 62, as shown in FIG. 4, the vessel body 32 of the canister 30 is put into the body 10 of the transportation cask 11 with its upper end open. In this stage, the shock absorbers 22 and 24 and the lid 20 are removed. Further, the basket 34 is placed in advance in the vessel body 32.

Subsequently, the compressed air is supplied to the elastic tube 50 that is fixed to the inner surface of the upper end portion of the body 10. Thereupon, the tube 50 is inflated and brought intimately into contact with the inner surface of the body 10 and the outer periphery of the upper end portion of the vessel body 32 of the canister 30. By doing this, the gap between the inner surface of the body 10 and the outer surface of the canister 30 is sealed by the elastic tube 50. Thus, the fluid is prevented from getting into the gap between the body 10 and the canister 30 through the top-opening side of the body.

Further, a gas such as uncontaminated air from outside the body 10 is filled into the space between the outer surface of the canister 30 and the inner surface of the body 10, which is sealed by the elastic tube 50, and each supply hole 52 is closed by the plug 54. Thus, the space that is sealed by the elastic tube 50 is filled with air, and the pressure in this space is kept at a level equal to or higher than external pressure, whereby penetration of the fluid can be prevented more securely. Thereupon, preparations for fuel loading are finished.

The filled fluid is not limited to air, and may be any other gas or a liquid such as pure water.

Figure 5:
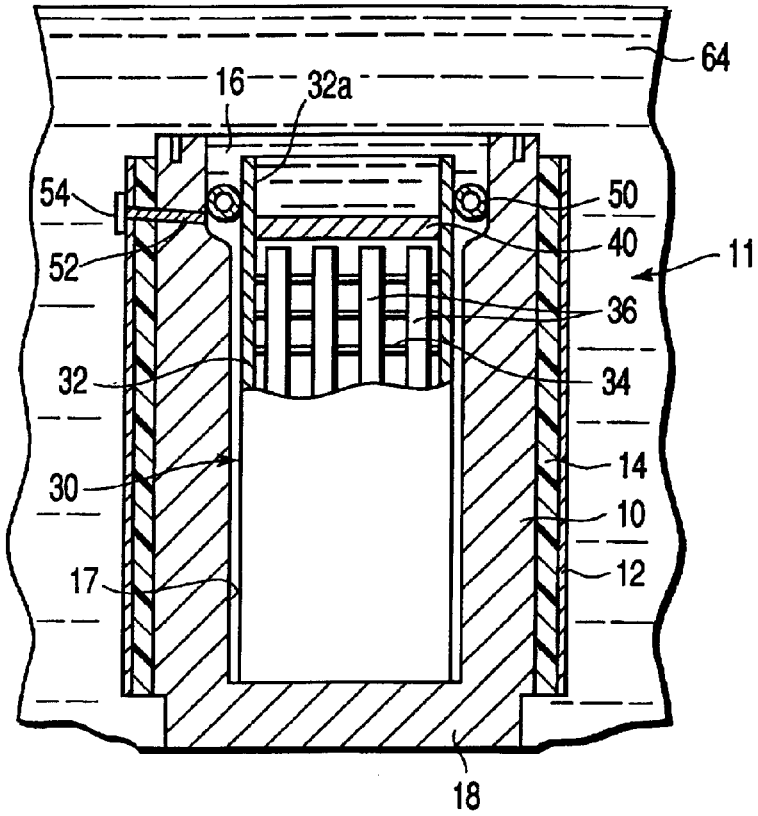
FIG. 5 is a sectional view showing the transportation cask body immersed in water in the spent fuel loading process.
Figure 6:
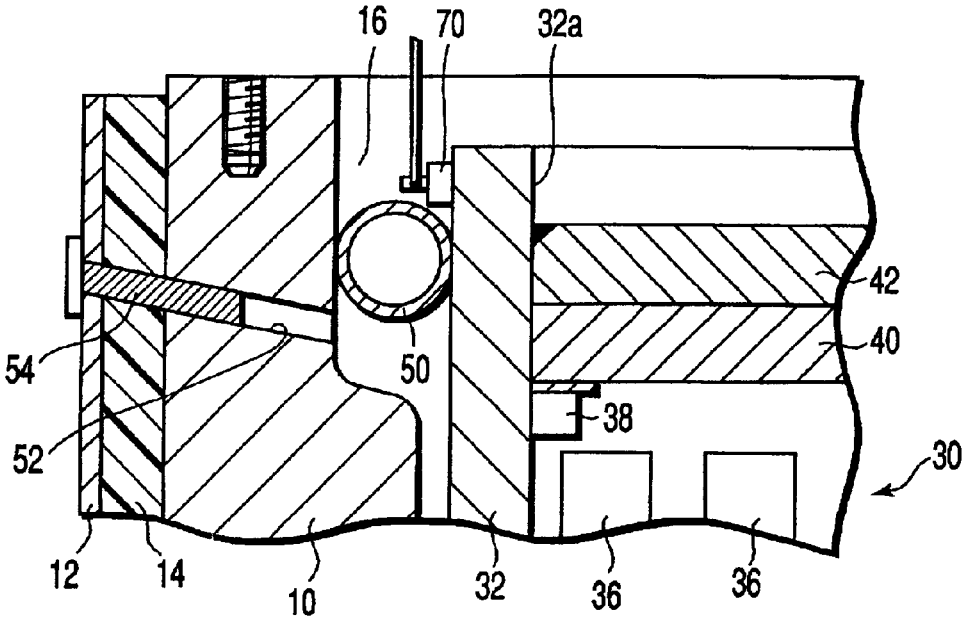
FIG. 6 is a sectional view of the upper part of the body of the transportation cask and the upper end portion of the canister contained therein, showing a state for the inspection of a welding portion that follows the welding process.

Subsequently, the body 10 of the transportation cask 11, containing the vessel body 32, is transferred to a cask loading pit 65 filled with cooling water 64 by means of an overhead traveling crane, and is immersed in the cooling water, as shown in FIGS. 4 and 5. Thereupon, the vessel body 32 and the upper end portion of the body 10 are filled with water. As this is done, there is no possibility of the contaminated cooling water 64 flowing into the gap between the body 10 and the vessel body 32 through the top opening of the body 10, since the space between the inner surface of the body 10 and the outer surface of the canister 30 is sealed by the elastic tube 50 and filled with air.

In the cask loading pit 65, the spent fuel assemblies 36, having so far been contained in a spent fuel rack 60 in a spent fuel pit 66, are pulled out one after another by means of a pit crane 67 and loaded in succession into the basket 16 in the vessel body 32. After a given number of spent fuel assembly 36 are loaded into the vessel body 32, the support plate and the shielding plate 40 are fitted successively into the top opening 32*a* of the vessel body 32.

Subsequently, the body 10 of the transportation cask 11 is pulled up from the cask loading pit 65 and transferred to the decontamination pit 62 by means of the overhead traveling crane. In the decontamination pit 62, a suitable quantity of cooling water is discharged from the vessel body 32 so that the surface of the cooling water 64 is situated slightly above the spent fuel assemblies 36.

In this state, the primary lid 42 is set in the top opening 32*a* of the vessel body 32 of the canister 30, and the peripheral edge portion of the upper end of the primary lid 42 is welded to the inner surface of the vessel body 32, whereupon the top opening of the vessel body is closed. After the welding operation, the tester, e.g., an ultrasonic sensor 70, is inserted into the inspection space 16 through the top opening of the body 10 and located outside the welding portion of the primary lid 42. The sensor 70 is used to check the welding portion of the primary lid 42 for its welding state in a direction substantially perpendicular to the welding portion or the outer peripheral surface of the vessel body 32, from the outside of the vessel body 32. The tester is not limited to the ultrasonic sensor, and an electromagnet sensor or any other tester may be used for the purpose.

Thereafter, complete dehydration of the interior of the vessel body 32, vacuum drying, inert gas replacement, sealing operation, welding portion inspection, and air leakage inspection are carried out. Then, the secondary lid 44 is set in the top opening 32*a* of the vessel body 32, and its outer peripheral edge portion is welded to the inner surface of the vessel body. Thereafter, the welding state of the secondary lid 44 is inspected by means of the ultrasonic sensor 70 in the same manner as aforesaid.

Subsequently, inert gas replacement in the space between the primary and secondary lids 42 and 44, sealing operation, welding portion inspection, and air leakage inspection are carried out. Thus, seal-welding operation for the lids of the canister 30 is finished, whereupon the canister is completed contained the spent fuel.

After the top opening of the body 10 of the transportation cask 11 is closed by the lid 20, the outer surface of the body 10 is washed. Further, the plug 54 is removed, and the air or pure water, having so far filled the aforesaid sealed space, is discharged. Finally, after the shock absorbers 22 and 24 are attached to the upper and lower ends of the body 10, respectively, a pre-transportation check is conducted, whereupon pre-shipment preparations are completed. Then, the transportation cask 11, thus containing the canister 30, is transported by truck or ship from a power plant to a containing facility.

According to the transportation cask 11 constructed in this manner, the gap between the outer surface of the vessel body 32 of the canister 30 and the inner surface of the body 10 is sealed by means of the elastic tube 50 that is provided between those surfaces near the top opening of the body 10. By doing this, the fluid can be prevented from getting into the gap between the vessel body 32 and the inner surface of the body 10 through the top opening of the body 10. Thus, in immersing the body 10, containing the vessel body 32 of the canister 30, in the cooling water 64 to set the spent fuel assemblies 36 in position, the cooling water can be prevented from flowing into the gap between the vessel body 32 and the inner surface of the body 10 through the top opening of the body 10. In consequence, the outer surface of the vessel body 32 can be prevented from being contaminated with the cooling water.

In immersing the body 10, containing the vessel body 32 of the canister 30, in the cooling water to set the radioactive substance in position, according to the transportation cask 11 with the aforementioned construction, moreover, a fluid such as air or pure water is injected in advance into the sealed space through the supply holes 52. By doing this, the contaminated cooling water can be prevented more securely from getting into the aforesaid space.

Thus, there may be provided a transportation cask and a loading method such that loading operation can be easily performed without the necessity of pulling up the vessel body 32 from the body 10 and washing it after it is loaded with the spent fuel assemblies 36.

The welding time can be shortened in a manner such that the welding portion is cooled with air supplied through the supply holes 52 as the primary and secondary lids are welded to the vessel body.

Furthermore, the elastic tube 50 is fixed to the inner surface of the body 10 of the transportation cask 11. If the canister 30 falls as it is loaded into or pull up from the containing portion 17 of the body 10, therefore, its falling speed can be considerably lowered by the elastic tube 50. Thus, the canister 30 and the body 10 can be prevented from being damaged.

According to the transportation cask 11 constructed in this manner, the annular inspection space 16 is defined between the upper end portion of the body 10 and the upper end portion of the vessel body 32 of the canister 30. Accordingly, the ultrasonic sensor 70 or some other tester can be inserted into the inspection space 16 to check the welding portions of the primary and secondary lids 42 and 44 of the canister 30 for the welding state in the direction perpendicular to the welding portions. Thus, the welding state of the primary and secondary lids 42 and 44 can be inspected securely, and the reliability of the welding can be improved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the ring-shaped seal member for preventing the penetration of the fluid is not limited to the elastic tube, and may alternatively be a solid member of an optional material that can be selected as required.

What is claimed is:

1. A transportation vessel for containing and transporting a closed vessel, which comprises a substantially tubular metallic vessel body, having a closed bottom and a top opening and configured to contain a radioactive substance, and a lid welded to the vessel body and closing the top opening of the vessel body, the transportation vessel comprising:

a body having a top opening and provided inside with a containing portion for containing the closed vessel;

a lid closing the top opening of the body; and a ring-shaped seal member provided between the outer surface of the closed vessel and the inner surface of the body, near the top opening, and configured to seal the gap between the outer surface of the closed vessel and the inner surface of the body and to prevent a fluid from getting into the gap between the outer and inner surfaces through the top opening.

2. A transportation vessel according to claim 1, wherein the seal member is in the form of an inflatable tube.

3. A transportation vessel according to claim 1, wherein the seal member is fixed to the inner surface of the body.

4. A transportation vessel according to claim 1, wherein the containing portion of the body includes a large-diameter portion which is located outside the lid of the closed vessel at an end portion on the top opening side and has a diameter greater than that of the other portion, the large-diameter portion defining an inspection space for the insertion of a tester in conjunction with the outer surface of the closed vessel, the seal member being located in the large-diameter portion.

5. A transportation vessel according to claim 1, wherein the body has a supply hole opening into a space sealed by the seal member and allowing the fluid to be fed into the space from outside the body.

6. A transportation vessel according to claim 1, which further comprises an outer tube located outside the body with a gap and a shield provided between the body and the outer tube to intercept neutrons.

7. A transportation vessel according to claim 1, which further comprises shock absorbers attached to top and bottom end portions of the body, individually.

8. A method of loading a closed vessel containing radioactive substance into the transportation vessel according to claim 1, the method comprising:

locating an empty vessel body with an opened top of the closed vessel in the containing portion of an open-topped body of the transportation vessel;

sealing the gap between the outer surface of the vessel body and the inner surface of the body by means of a ring-shaped seal member provided between the outer surface of the vessel body and the inner surface of the body, near the top opening of the body, thereby preventing a fluid from getting into the gap between the vessel body and the inner surface of the body through the top opening;

immersing the body containing the vessel body in water in a state such that the gap between the outer surface of the vessel body and the inner surface of the body is sealed by the seal member;

loading a radioactive substance into the vessel body in the water;

setting a shield member in the top opening of the vessel body in the water after loading the radioactive substance;

pulling up the body from the water after setting the shield member and then discharging a given quantity of water from the vessel body and the body; and welding the lid to the inner surface of the vessel body after discharging the water.

9. A method of loading a closed vessel according to claim 8, wherein the body is immersed in the water after a compressed fluid is loaded into a space sealed by the seal member.

10. A method of loading a closed vessel according to claim 8, which further comprises inserting a tester into the gap between the vessel body and the body, outside the welding portion, and inspecting the welding state after the lid is welded to the vessel body.

11. A transportation vessel according to claim 1, wherein the closed vessel is removable from the containing portion through the top opening of the body.

* * * * *

UNITED STATES PATENT AND TRADEMARK OFFICE

CERTIFICATE OF CORRECTION

PATENT NO. : 6,727,510 B2
DATED : April 27, 2004
INVENTOR(S) : Matsunaga et al.

It is certified that error appears in the above-identified patent and that said Letters Patent is hereby corrected as shown below:

Title page,
Item [75], Inventors, should read:
-- [75] Inventors: Kenichi Matsunaga, Kobe (JP); Ganji Abe, Kobe (JP); Koichi Ue, Kobe (JP); Koji Enami, Takasago (JP); Seiichi Wakayama, Takasago (JP); Etsuryo Kita, Kobe (JP); Shizuo Inoue, Kobe (JP) --

Signed and Sealed this

Twenty-third Day of November, 2004

JON W. DUDAS
*Director of the United States Patent and Trademark Office*